US006003351A

United States Patent [19]

Chao et al.

[11] Patent Number: 6,003,351

[45] Date of Patent: Dec. 21, 1999

[54] STRUCTURE FOR A MORTISE LOCK

[75] Inventors: Ping-Y. Chao; Chorng-Yang Huang, both of Kaohsiung, Taiwan

[73] Assignee: National Science Council of Republic of China, Taipei, Taiwan

[21] Appl. No.: 09/005,041

[22] Filed: Jan. 9, 1998

[51] Int. Cl.[6] ..... E05B 27/00

[52] U.S. Cl. ..... 70/366; 70/490; 70/375

[58] Field of Search ..... 70/366, DIG. 4, 70/DIG. 23, DIG. 24, 357, 490, 365, 375, 377

[56] References Cited

U.S. PATENT DOCUMENTS

| | | | |
|---|---|---|---|
| 2,808,717 | 10/1957 | Jacobi | 70/366 |
| 3,029,626 | 4/1962 | Jacobi | 70/366 |
| 3,695,073 | 10/1972 | Prescott | 70/366 |
| 3,789,638 | 2/1974 | Roberts et al. | 70/366 |
| 3,881,333 | 5/1975 | Christmas | 70/490 |
| 4,008,588 | 2/1977 | Miller et al. | 70/366 |
| 4,083,212 | 4/1978 | Proefrock | 70/366 |
| 4,336,700 | 6/1982 | Baltscheffsky et al. | 70/366 |
| 4,351,172 | 9/1982 | Martikainen | 70/366 |

FOREIGN PATENT DOCUMENTS

| | | | |
|---|---|---|---|
| 2062074 | 6/1972 | Germany | 70/366 |
| 1367356 | 9/1974 | United Kingdom | 70/366 |

*Primary Examiner*—Darnell M. Boucher
*Attorney, Agent, or Firm*—Dougherty & Troxell

[57] ABSTRACT

The present invention discloses an improved structure for a mortise lock comprising a lock body, a lock core, a plurality of spring washers, a plurality of straps and a latch in the lock body. Each spring washer has a curved portion to hook onto the washer holding slot, a claw to hook onto the strap tenon or the washer holding slot and a rim slot to forcibly contact the positioning pin and indirectly hold the strap tenon. With such mechanism a resilient force may be produced to prevent the straps from being shifted out of their positions due to vibration even after the lock is opened. This improved structure makes the mortise lock of the present invention can not only be used on static objects such as telephone sets or mail boxes, but also effectively applicable to any moving object.

2 Claims, 10 Drawing Sheets

STRUCTURE FOR A MORTISE LOCK

BACKGROUND OF THE INVENTION

1. Field of the Invention

The present invention relates to an improved structure of a mortise lock, and particularly relates to a lock which can provide reliable resilient force with its spring washers to prevent deviated position shift of its straps even equipped on an unstably moving object.

2. Description of the Prior Art

A mortise lock is used mostly for a static object, such as a telephone set, or sometime its internal structure can be applied to a rim lock. There are three conventional types of the mortise lock commonly used nowadays, they are 7 straps, 9 straps and 11 straps type, the number of notches for the corresponding keys will be 7, 9 and 11 respectively. In general, the degree of security for a lock increases with increasing the number of the straps, it will be well understood that each strap has a notch of different position, as a result, the variation and complication for the key feature will increase as the number of lock straps with different notch positions increases which leads to a more assured security for a mortise lock. For example, a mortise lock consisting of 9 straps with 5 different notch positions has 1953125 possible different combinations for corresponding key features, if the number of straps increases to 11, the above mentioned combinations will become so high as 48828125. The principle of opening a mortise lock is: turning the key to remove the notches on the straps to a correct position aligning in a straight line so as to release the latch which is formally blocked.

However, since each strap is separated by a washer there-between to assure independence of the interference from an external force so that the straps may not shift during vibration which lead to the difficulty of inserting the key into the key hole, thus the mortise lock is definitely suitable for an object standing still, but it is inconvenient to use on a moving object.

It is apparent from the above description that there are several disadvantages which restrict the application field for the conventional mortise lock unless some improvements are done.

SUMMARY OF THE INVENTION

It is an object of the present invention to provide an improved structure for a mortise lock which can prevent the deviating position shift of the straps to increase the reliability of a lock.

To achieve this object, the present invention provides an improved structure for a mortise lock comprising a main lock body, a lock core, a plurality of spring washers, a plurality of straps and a latch, wherein the spring washers are used instead of common washers which can prevent the deviating position shift of the straps.

Another object of the present invention is to provide an improved structure for a mortise lock which is easy for assembly and able to resist vibration.

To achieve this object, the present invention provides a positioning pin which can simplify a step of assembling nine spring washers to a step of assembling two spring washers, also by simplifying the structure of the lock core, vibrating affect to the lock can be minimized, assembly work facilitated, and convenience attained.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENTS

Figure 1C:
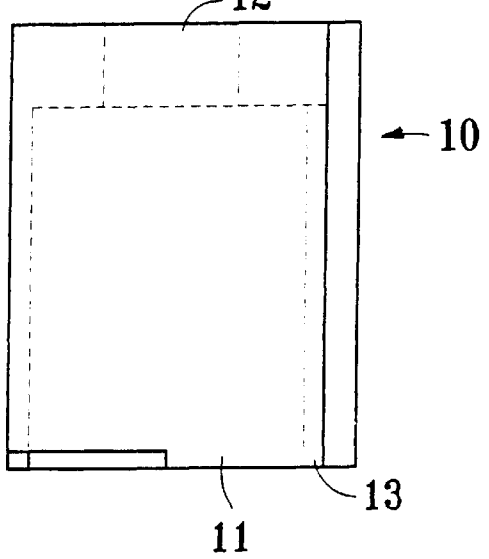
FIGS. 1*a*–1*c* are front, top and side views of the lock block of the present invention.
Figure 1B:
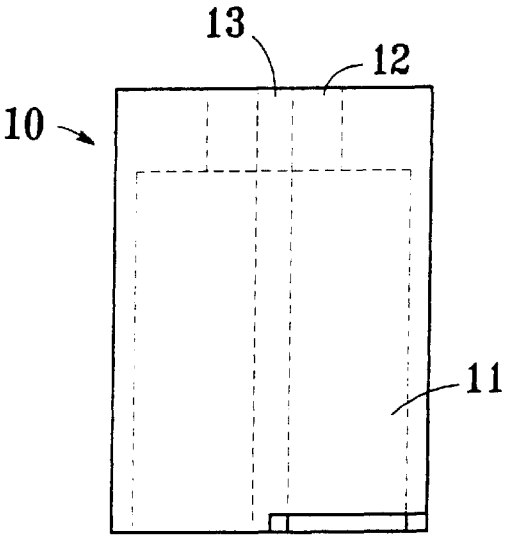
Figure 1A:
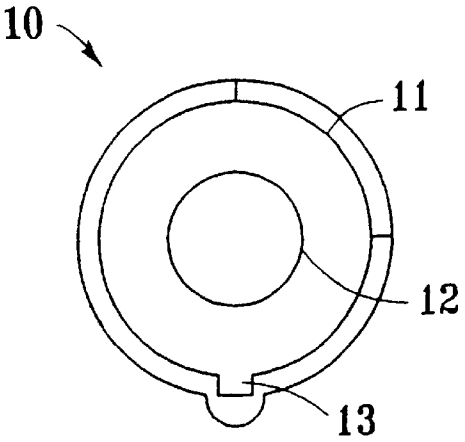

The structure for a conventional mortise lock can be described in three portions:

1. Lock block 10: The lock block 10 is a main body of the lock which is observed as a main structure of a mortise lock as shown in FIGS. 1*a*–1*c*, the lock block 10 mainly comprises:

(1) Lock center hole 11: For fixing the lock core portion and providing the space for lock core to turn.

(2) Key hole 12: For accepting insertion of a key, generally formed in circular shape, besides for inserting a key to open the lock, it also provide a space allowing the key to turn.

(3) Latch hole 13: This is a structure for accommodating the latch which prevents the lock core from turning.

Figure 2C:
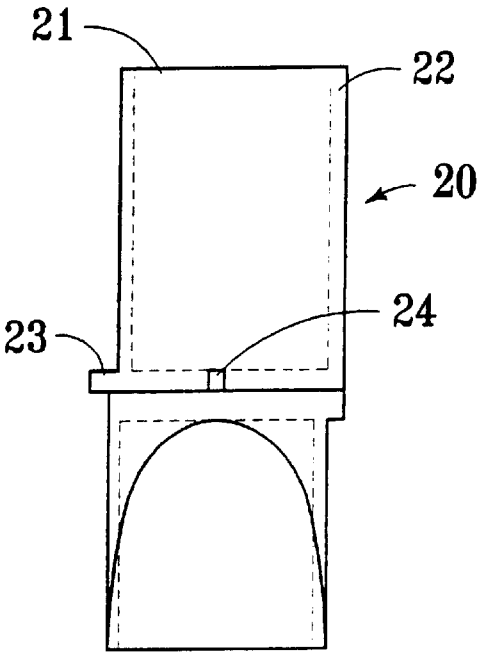
FIGS. 2*a*–2*c* are front, top and side views of the structure for the lock core portion of the present invention.
Figure 2B:
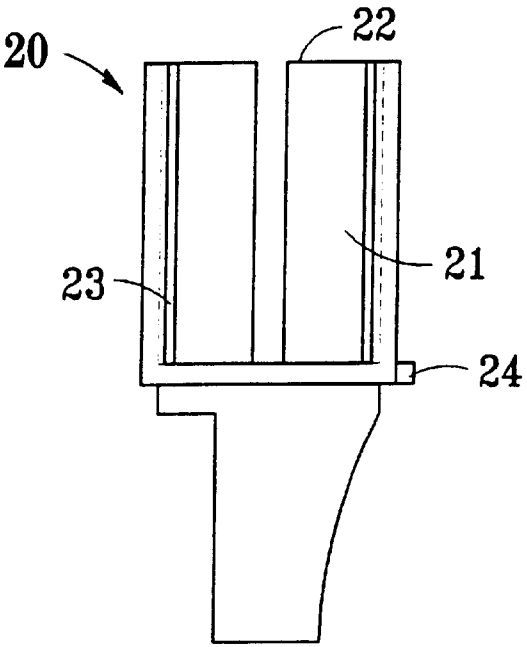
Figure 2A:
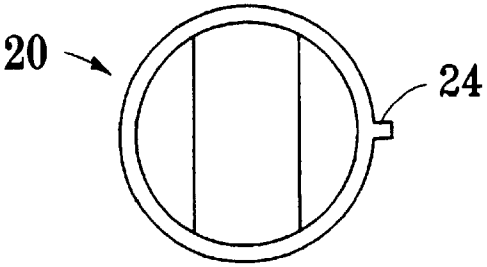
Figure 3A:
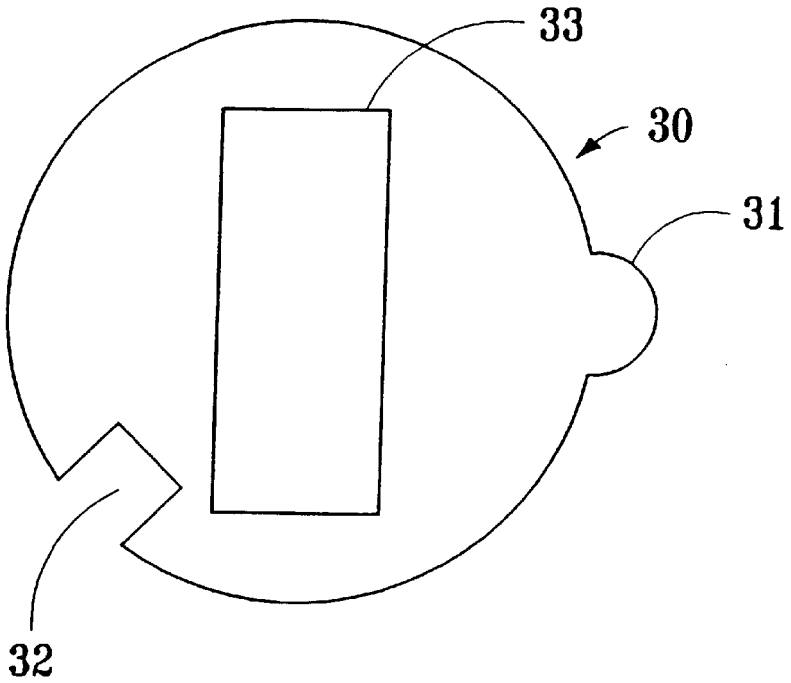
FIGS. 3*a*–3*c* are front, top and side views of the structure of a strap of the present invention.
Figure 3B:
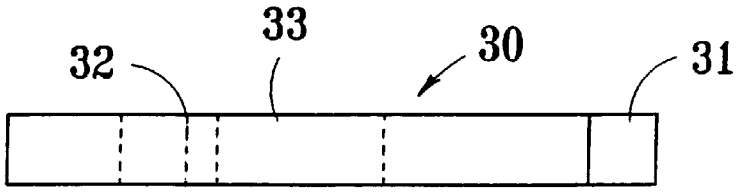
Figure 3C:
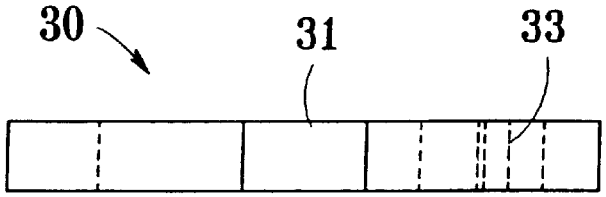

2. Lock core portion 20: This structure mainly provides a space for accommodating other elements of the lock, as shown in FIGS. 2*a*–2*c*, the lock core portion 20 includes:

(1) Strap hole 21: Since a mortise lock depends on the figure variation of its straps to define the construction of its key such that a key can be inserted into a key hole if both have the same serial number, in the case that a key is not completely fitted for the lock, the key can not be accepted.

(2) Latch hole 22: This is a space for accommodating the latch which can prevent turning of the lock core portion 20.

(3) Washer holding slot 23: It can hold the washer at an appropriate position by stopping the flange of a washer such that the washer will not follow the rotation of the strap when being turned by a key.

(4) Positioning tenon 24: The structure may fix the lock core portion 20 at an defined position in the positioning slot provided in the lock block after the lock core portion has turned a certain angle.

3. Miscellaneous components: Miscellaneous components are shown in FIGS. 3*a*–3*c* and 4*a*–4*c* they are:

(1) Straps 30: They are installed inside the hole of the lock core portion, each strap 30 has a strap tenon 31, a notch 32, and a key hole 33 thereon Each strap is given a defined serial number according to particular position of its notch 32. In general, there are four to five variations of notch position for the combination of the straps which forms a mortise lock. The structure of an exemplary strap 30 is shown in FIG. 3.

Figure 4A:
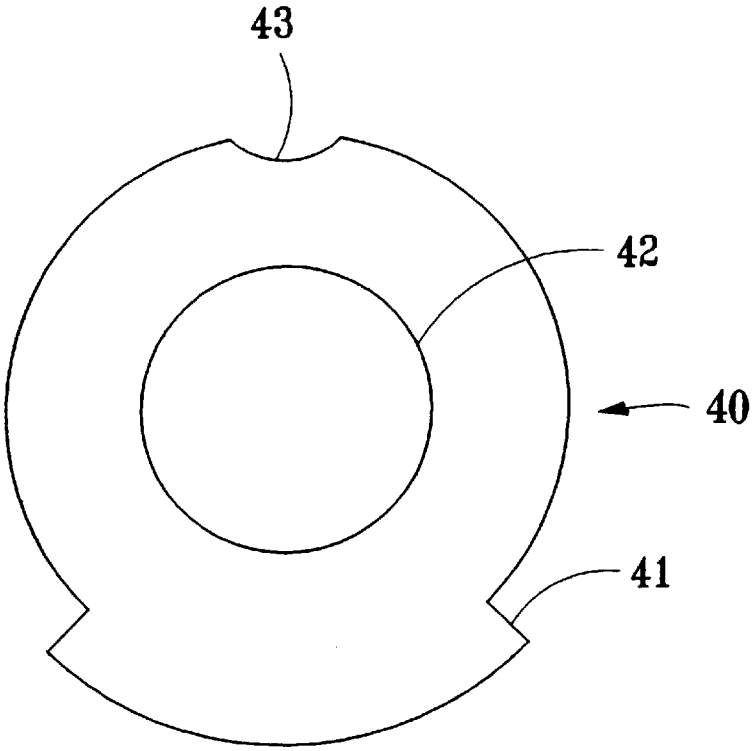
FIGS. 4*a*–4*c* are front, top and side views of the structure of a washer of the present invention.
Figure 4B:
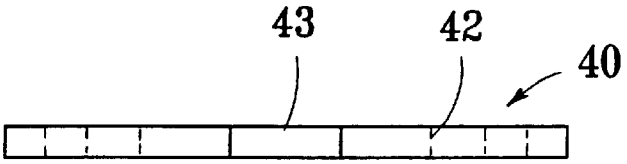
Figure 4C:
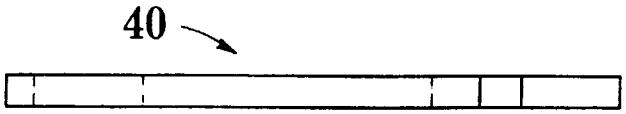

(2) Washer 40: Washer 40 is a spacer for separating two adjacent straps 30.By interposing a washer 40 between two adjacent straps 30, the allowable average deviation in thickness of each notch on the key may be equal to ½ thickness of the washer 40. The structure of the washer 40 includes a washer flange 41, a circular key hole 42 and a slot 43, as shown in FIGS. 4*a*–4*a*.

(3) The latch 50: When the latch 50 is in a locked state, the center of the lock core portion is fixed by the lock block and can not move. As a correct key is inserted and turned such that all the straps are rotated to align their notches in a straight line, at this time the protrusion of the latch will fall into the space of aligned notches to allow releasing of the latch and turning center of the lock core portion for opening the lock.

At present, assembly of a mortise lock is performed manually by the steps of:

(1) combining the tenon with the lock (2) taking out the key;

(3) assembling straps and washers in order with respect to the figure of the key;

(4) inserting the latch;

(5) installing the lock block;

(6) adding the lock body, fixing it, thus the assembly is performed.

The reasons why the straps of a conventional manually assembled mortise lock may deviate from their positions by vibration are as follows:

1. The function of a washer is only for separation of straps, it possibly slightly reduces the production cost by increasing the reliability of a lock, but it increases the complexity of assembly.
2. When disposing the straps, no means for protection against the external vibration are put into consideration.

To solve the above two problems, the present invention provided a clever solution which will be described in detail in the preferred embodiments hereinafter:

In a first embodiment of the present invention, the strap 30 is allowed to turn freely in the lock core portion 20, and deviating shift of the straps 30 by vibration is prevented by the resilient force of the spring washers 60 interposed between straps 30.

Such an improvement is performed mainly through changing conventional washer 40 to spring washer 60 of similar thickness.

Figure 5:
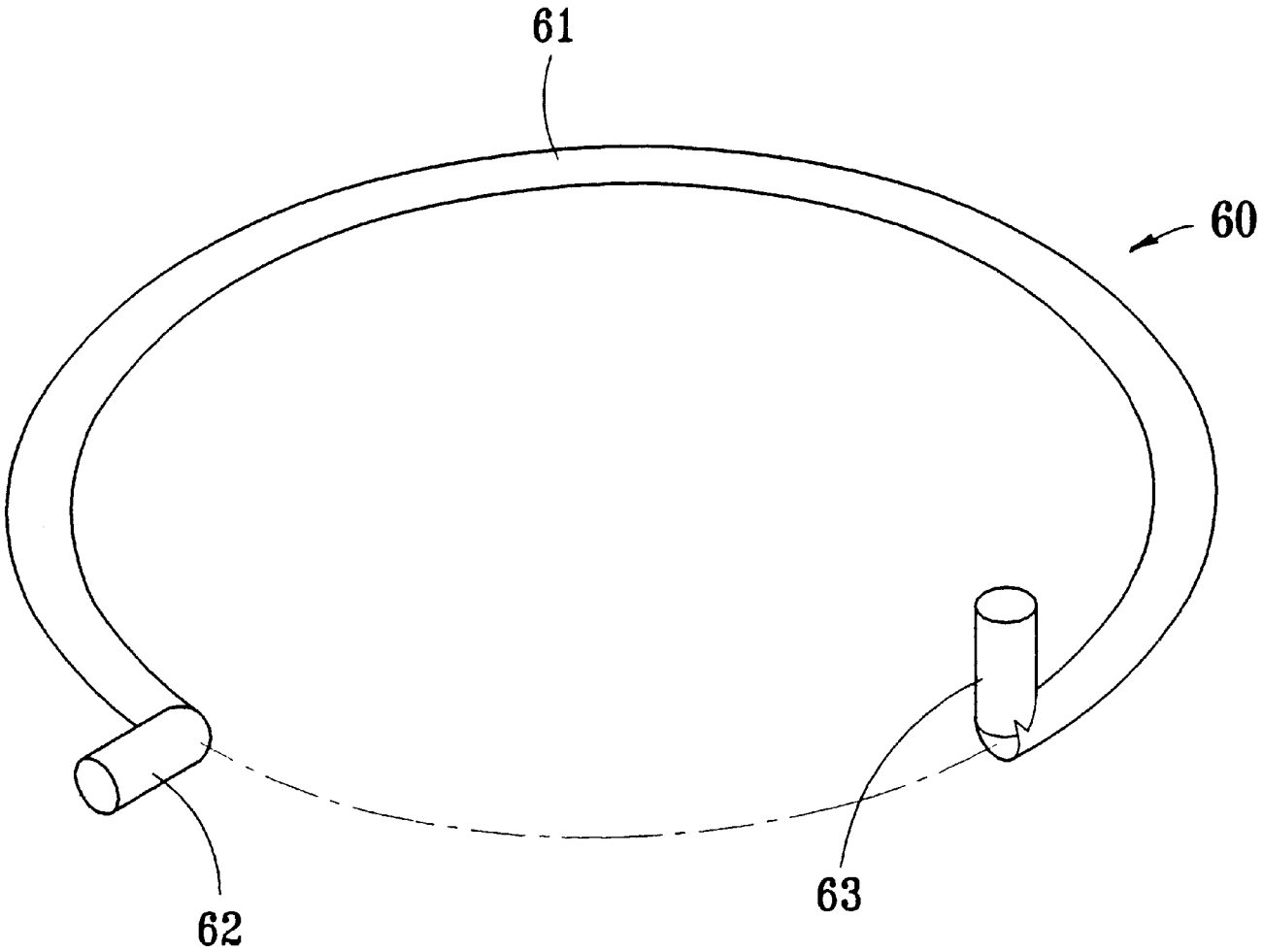
FIG. 5 is a drawing showing a spring washer in a first embodiment of the present invention.

The improved spring washer 60 can not only function as a conventional washer 40, but also leniently enlarges the allowable dimensional errors for the strap 30; and moreover, provides resilient force such as to prevent the strap 30 from deviating from its correct position by vibration. As shown in FIG. 5, the structure of a spring washer 60 further includes a main body 61, a curved portion 62 and a claw 63, wherein the main body 61 provides a resilient force by straining, the curved portion 62 is for hooking onto the washer holding slot 23, and claw 63 is for hooking onto the strap tenon 31. By using a spring washer 60 combined together with a strap 30 to locate in the lock core portion 20, the positioning resilient force required by each strap 30 can be provided by each corresponding spring washer 60 respectively.

The steps of assembling a mortise lock of the present invention include:

(1) combining the tenon with the lock (2) selecting a suitable key;

(3) selecting a strap corresponding to the selected key;

(4) inserting a spring washer 60 into the lock core portion 20 and hooking the curved portion 62 onto the washer holding slot 23;

(5) setting the strap 30;

(6) when the strap 30 is set on the spring washer 60, hooking the claw 63 onto the strap tenon 31 by pulling and opening it; and repeating the steps (4) to (6):

(7) inserting the latch 50;

(8) installing the lock block, and adding the lock body.

Figure 9:
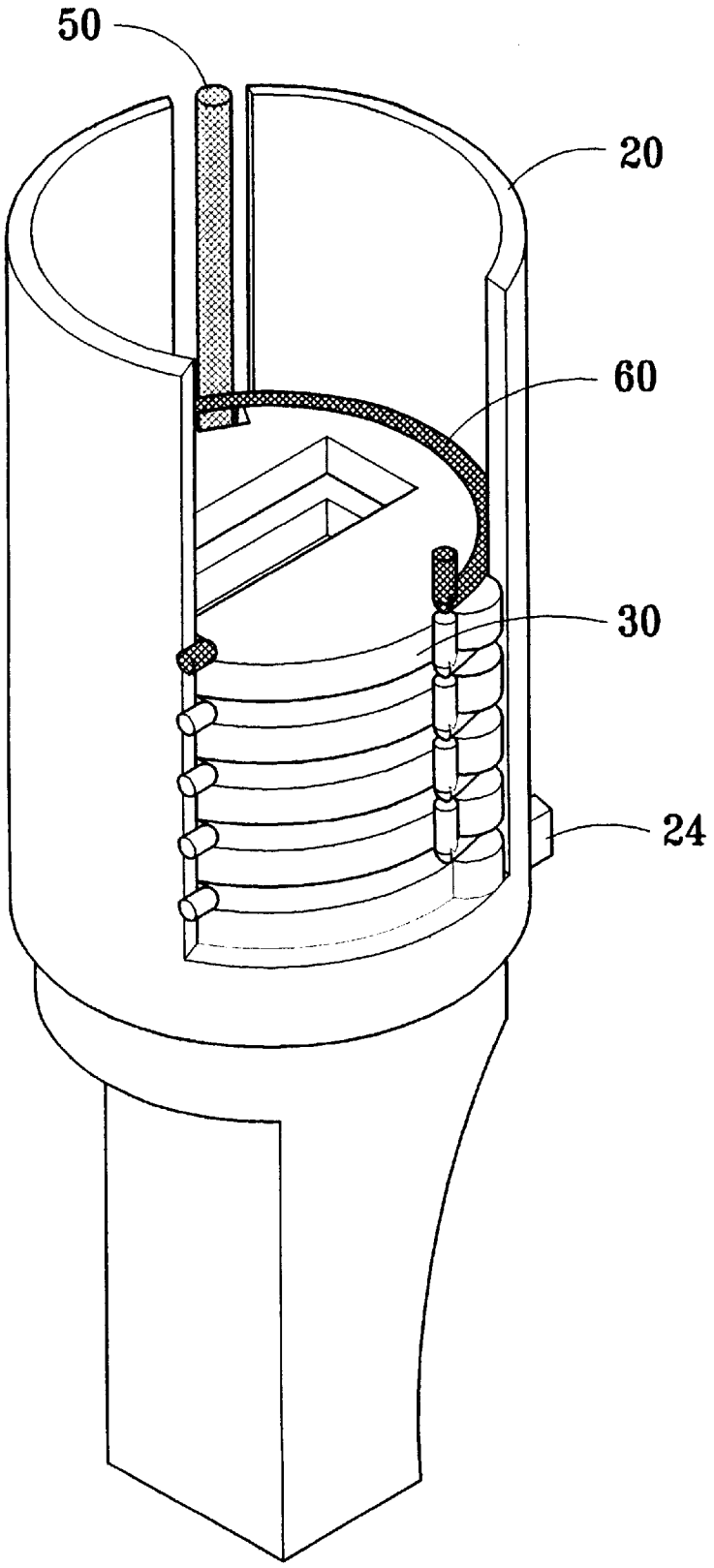
FIG. 9 is a three-dimensional illustrative drawing of a mortise lock in a first embodiment of the present invention.

A first embodiment of the present invention is shown in FIG. 9, the main advantages of using the spring washers 60 to provide a resilient force by straining the main body 61 to fix the straps 30 are:

(1) The amount of components is not increased by using the spring washer 60.

(2) The deviating position shift of the straps 30 never occurs after using spring washers 60.

It is well understood through the above description of a first embodiment of the present invention, the deviative position shift of the strap 30 is completely prevented by replacing the conventional washer 40 with the spring washer 60.

Figure 6:
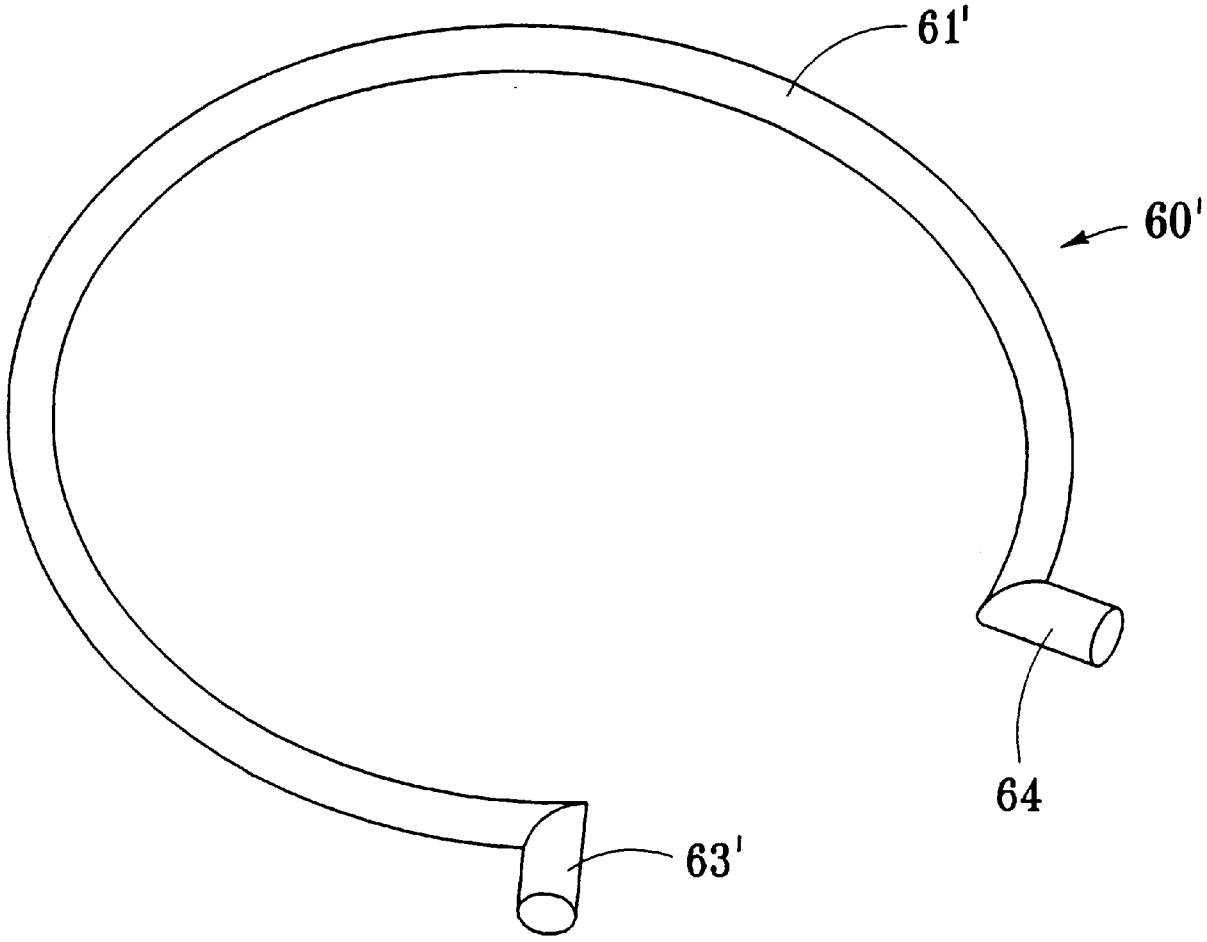
FIG. 6 is a drawing showing a spring washer in a second embodiment of the present invention.

In a second embodiment, a spring washer 60' with the thickness similar to that of a conventional washer 40 is employed to replace 2 to 3 pieces of the conventional washer 40. The spring washer 60' can not only function as a conventional washer 40, but also leniently enlarges allowable dimensional errors for the strap 30, and moreover, provides a resilient force so as to prevent the straps 30 from deviating from its correct position by vibration. As shown in FIG. 6, the structure of a spring washer 60' further includes a main body 61', a claw 63' and a curved portion 64 for positioning pin, wherein the main body 61 provides a resilient force by straining, the claw 63 is for hooking onto the washer holding slot 23, and curved portion 64 is for hooking onto the positioning pin 70. By means of a combination of 2 to 3 spring washers 60' together with a positioning pin 70 and the straps 30 setting in the lock core portion 20, the resilient force provided by the spring washers 60' can directly set the positioning pin at its position, and then indirectly control the straps 30 at their positions to prevent their deviating position shift.

Figure 7:
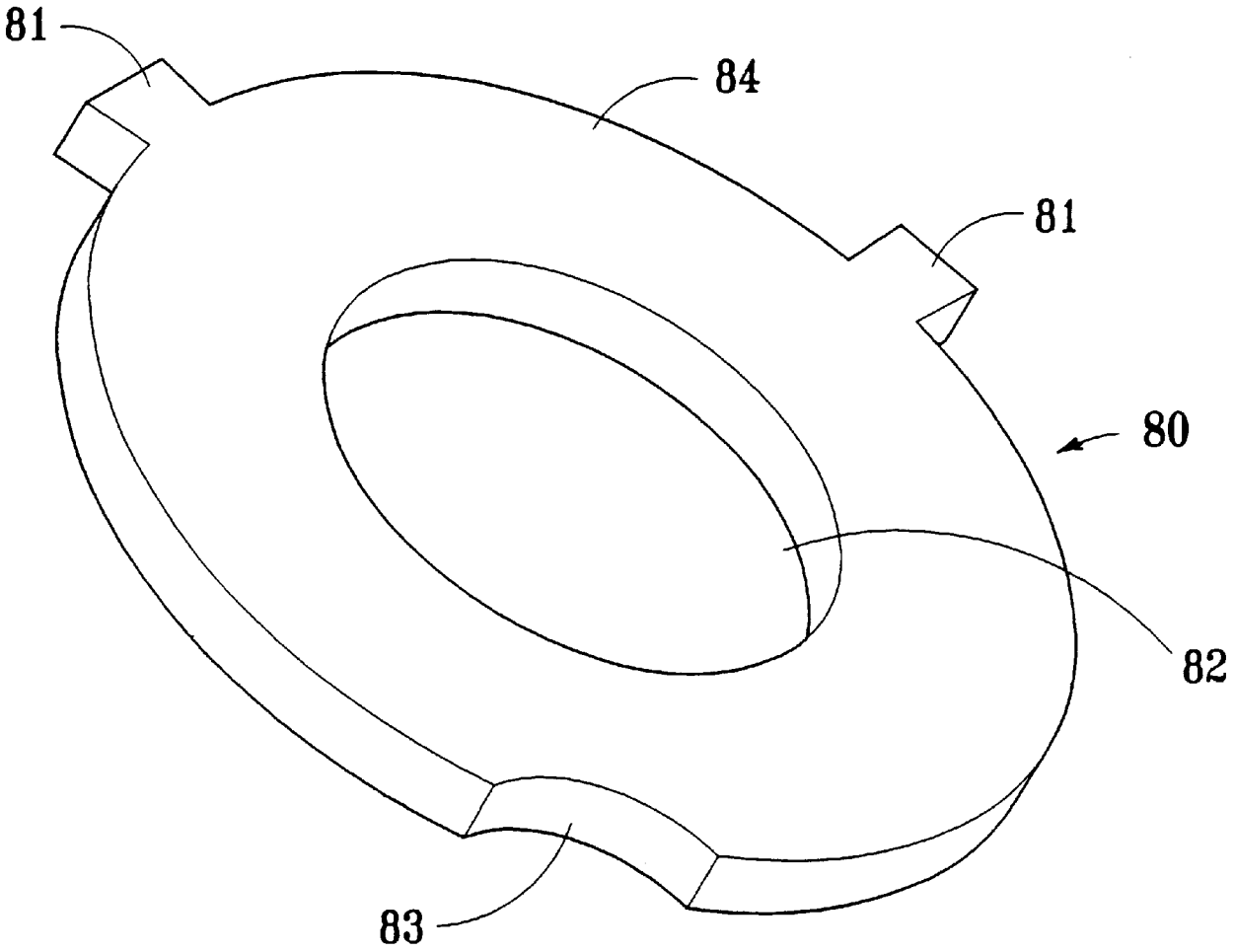
FIG. 7 is a drawing showing the structure of a new washer of the present invention.
Figure 8:
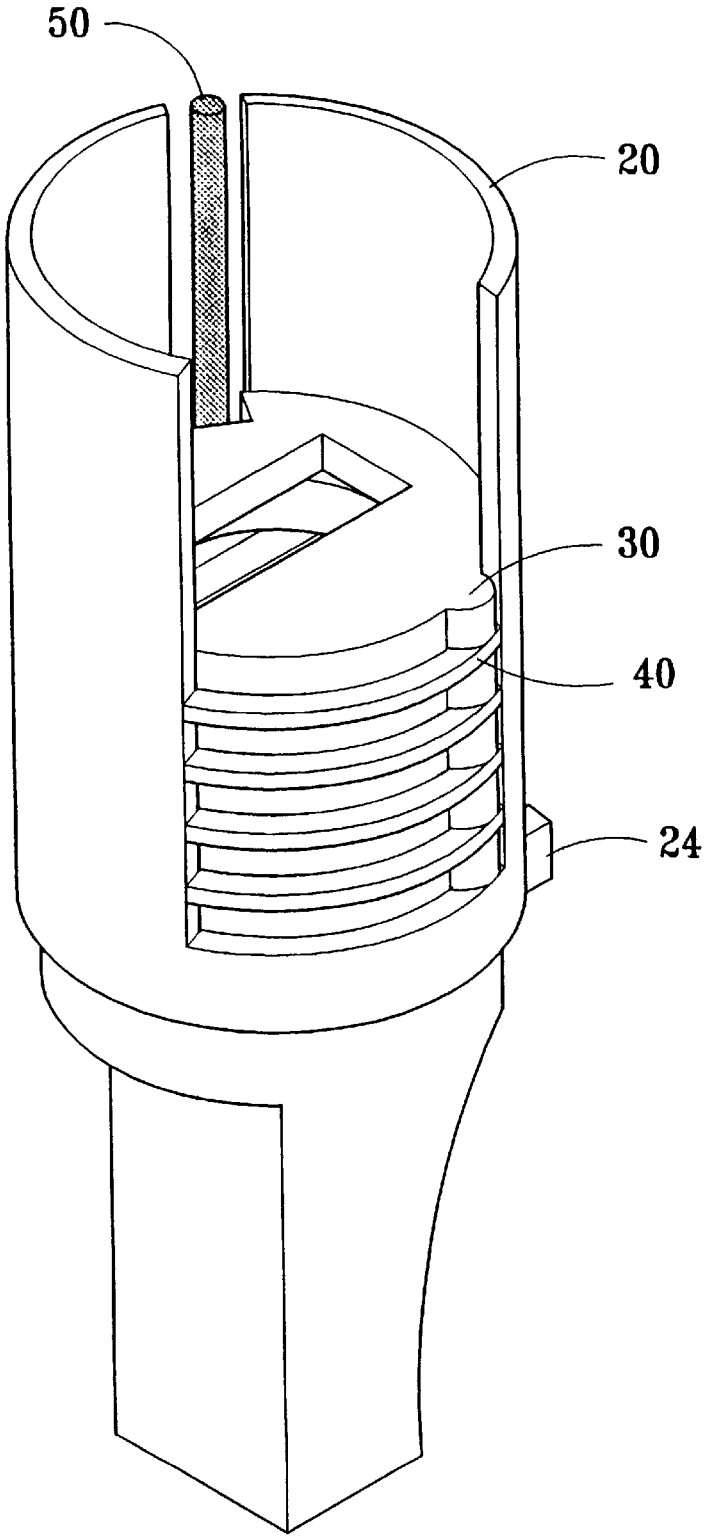
FIG. 8 (PRIOR ART)
FIG. 8 is a three-dimensional illustrative drawing of a conventional mortise lock.
Figure 10:
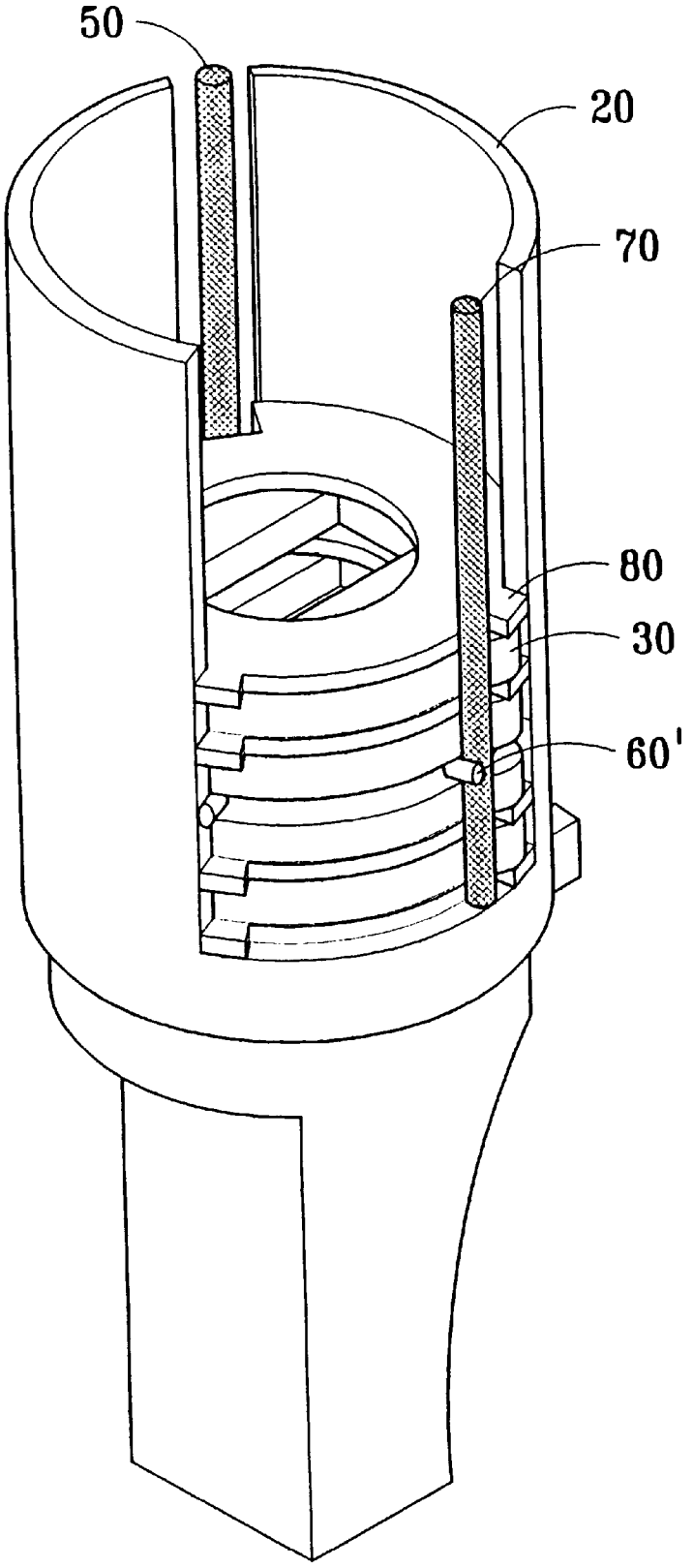
FIG. 10 is a three dimensional illustrative drawing of a mortise lock in a second embodiment of the present invention.

A second embodiment is shown in FIGS. 7 and 10, wherein a new washer 80 includes a washer flange 81, a circular key hole 82, a latch slot 83, and a rim slot 84 for turning the positioning pin 70. In the embodiment two pieces of the spring washer 60' are installed in the lock, and rest of the washers installed between the straps are all new washers 80. By means of the claw 63' of the spring washer 60' holding the washer holding slot 23 and the curved portion 64 holding the positioning pin 70 so that the positioning pin can be fixed and positioned by forcibly contacting the strap tenon 31. The advantages of this embodiment is its conveniency in assembly which includes the steps of:

(1) combining the tenon with the lock;

(2) selecting a suitable key 90;

(3) selecting the straps 30 corresponding to the selected key 90;

(4) disposing the straps 30, new washer 80 and the spring washers 60' in the lock core portion 20 in order, it is recommended that the new washers to be placed at the upper and lower positions symmetrically, i.e. to be placed between the upper second and third straps, and between the lower second and third straps, with the claw 63' holding onto the washer holding slot 23;

(5) pulling the curved portion 64 towards the claw 63';

(6) inserting the positioning pin 70 between the curved portion 64 and the strap tenons 31;

(7) inserting the latch 50 into the lock block 10, and enclosing with the lock body to complete assembling. The advantages of the structure for a mortise lock can be enumerated as follows:

(1) The assembly work is much simplified by additional use of a positioning pin 70 and reduced number of spring washers 60';

(2) The deviating position shift of the straps 30 is rectified by using the spring washers 60'.

From the foregoing description, addition of a positioning pin 70 may result in simplifying the assembly work by reducing the necessary spring washers 60' from 9 to 2, and in addition, mimizing the affect of vibration to the lock.

Many changes and modifications in the above described embodiments of the invention can, of course, be carried out without departing from the scope thereof.

Accordingly, to promote the progress in science and the useful arts, the invention is disclosed and is intended to be limited only by the scope of the appended claims.

What is claimed is:

1. An anti-vibration mortise lock comprising:

a) a lock body having a lock center hole, and a key hole communicating with the lock center hole;

b) a lock core movably mounted in the lock center hole, the lock core having a strap hole bounded by an inner wall surface, and a holding slot through a side of the lock core in communication with the strap opening, the holding slot having a side edge and an opposite edge both extending in axial directions;

c) a plurality of straps movably located in the strap hole of the lock core, each strap movable between locked and unlocked positions, and having a strap tenon extending outwardly from a periphery of the strap and into the holding slot, and a strap keyhole therethrough; and, d) a plurality of spring washers, one spring washer located between each adjacent pair of straps, the spring washer having a main body having first and second opposite ends, a curved portion extending from the first end and engaging the side edge of the holding slot, and a claw extending from the second end and engaging a strap tenon, the spring washer exerting a force on the associated strap when the strap is in the locked position urging the strap tenon against the opposite edge of the holding slot to prevent displacement of the straps from the locked position by vibration of the lock, the main body bearing against the inner wall of the lock core.

2. An anti-vibration mortise lock comprising:

a) a lock body having a lock center hole, and a key hole communicating with the lock center hole;

b) a lock core movably mounted in the lock center hole, the lock core having a strap hole, bounded by an inner wall surface, and a holding slot through a side of the lock core in communication with the strap opening, the holding slot having a side edge and an opposite edge both extending in axial directions;

c) a plurality of straps movably located in the strap hole of the lock core, each strap movable between locked and unlocked positions, and having a strap tenon extending outwardly from a periphery of the strap and into the holding slot, and a strap keyhole therethrough;

d) a spring washer located between at least one first pair of adjacent straps, the spring washer having a main body with first and second opposite ends, a claw extending from the first end and engaging the side edge of the holding slot and a curved portion extending from the second end into the holding slot;

e) a washer located between at least one second pair of straps, the washer having a washer keyhole, and a washer flange extending outwardly from a periphery of the washer and into the holding slot; and, f) a positioning pin located in the holding slot and engaged by the curved portion of the spring washer, the spring washer exerting a force on the positioning pin when the straps are in the locked position urging the positioning pin against each strap tenon and each washer flange thereby urging the strap tenons and washer flanges against the opposite side of the holding slot to prevent displacement of the strap from the locked position by vibration of the lock.

* * * * *